United States Patent [19]

Hashimoto et al.

[11] Patent Number: 4,767,688

[45] Date of Patent: Aug. 30, 1988

[54] CHARGE CONTROLLING METHOD AND DEVELOPERS CONTAINING A CHARGE-EXCHANGE CONTROL AGENT COMPRISING ORGANIC BORON COMPOUND

[75] Inventors: Ken Hashimoto; Masayuki Maruta; Hidehiko Soyama; Yukihiro Ishii, all of Kanagawa, Japan

[73] Assignee: Fuji Xerox Co., Ltd., Tokyo, Japan

[21] Appl. No.: 23,415

[22] Filed: Mar. 9, 1987

[30] Foreign Application Priority Data

Mar. 7, 1986 [JP] Japan ..... 61-48439

[51] Int. Cl.[4] ..... G03G 9/08

[52] U.S. Cl. ..... 430/110; 430/108; 430/115

[58] Field of Search ..... 430/110, 108, 115

[56] References Cited

U.S. PATENT DOCUMENTS 4,500,625 2/1985 Kita et al. ..... 430/149 X

*Primary Examiner*—J. David Welsh

*Attorney, Agent, or Firm*—Sughrue, Mion, Zinn, Macpeak & Seas

[57] ABSTRACT

A method for controlling charging of toner particles and/or charge-imparting materials used in electrophotography is disclosed, which comprises using as a charge-exchange control agent an organic boron compound composed of a boron-containing organic anion component and a cation component. A color developer containing the charge-exchange control agent is also disclosed, which is free from variation of tone and reduction of transparency due to the addition of the charge-exchange control agent.

18 Claims, No Drawings

CHARGE CONTROLLING METHOD AND DEVELOPERS CONTAINING A CHARGE-EXCHANGE CONTROL AGENT COMPRISING ORGANIC BORON COMPOUND

BACKGROUND OF THE INVENTION

The present invention relates to a charge controlling method and a developer containing a charge-exchange control agent, that is used to make visible electrostatic latent images formed in electrophotography or electrical signals provided in electrostatic recording. More particularly, the present invention relates to a developer that has good characteristics in terms of negative charging, and development and transfer of an image, and to a charge-exchange control agent used therein.

Toner particles contained in developers (toners) may be charged by a variety of techniques such as triboelectrification, contact electrification, irradiation with ions, static induction making use of electrical conductivity, and charge implantation. Of these, the first two methods are most easily available and hence are used extensively. Toners to be charged by either triboelectrification or contact electrification are classified into two types according to the charge imparting mechanism: a two-component developer which is composed of a mixture of toner particles and carrier particles to be charged for the polarity opposite to that of toner charging; and a single-component developer which is charged by the rubbing of toner particles, either with themselves or with charging blades or rollers.

The charging of toner particles in contact electrification or triboelectrification is typically controlled by adding electron donors or acceptors to the toner particles or the charge imparting materials such as carrier particles or blades. Triboelectrification is a complex phenomenon and its mechanism is not fully understood, but in general the electron donor is positively charged and the electron acceptor charged negatively.

Conventionally, the charging of toner particles is controlled by using additives, such as dyes, pigments, surfactants or inorganic powders, in the interior or on the surface of the toner particles, as described, for example, in U.S. Pat. Nos. 3,779,926, 3,893,935, 4,298,672, 3,944,493, 4,007,293, 4,079,014, and 4,394,430, or by using as binder resins those resinous materials having functional groups such as —COOH, —CN, a halogen (e.g., —Cl), —$NO_2$ or —$NH_2$, as described, for example, in U.S. Pat. Nos. 3,985,664 and 4,049,477.

However, the use of such conventional additives or binder resins has met with only limited success in controlling toner chargeability, and fully satisfactory levels of stability for storage and relative to environmental factors have not been attained. In particular, color toners allow only limited materials to be used as a charge-exchange control agent since inappropriate materials may cause variation of tone or reduced transparency. Furthermore, dyes or pigments which are used as coloring agents often cause adverse effects on toner chargeability and render it more difficult to control the charging of color toners than in the case of black toners.

It has recently been proposed that finer toner particles be used in order to produce copies with high-quality images as manifested by good reproduction of fine lines or dots in halftone image. If color images are to be formed by the subtractive process using three or four overlapping color toners, the decrease in the size of toner particles has the advantage of allowing a color image of high quality to be readily formed by preventing the excessive buildup of image or the occurrence of excessive gloss on account of overlapping toner layers. On the other hand, because of the small toner particle size, the content of dyes or pigments must be increased in order to achieve coloration that is comparable to that attainable with ordinary sized toner particles and this leads to further difficulties in attempts to successfully control the charging of toners.

SUMMARY OF THE INVENTION

One object of the present invention is to provide a method for controlling charging of toner particles and/or charge-imparting materials used in an electrophotographic machine using a specific charge-exchange control agent free from the above defects.

Another object of the present invention is to provide developers that have a fast rise time of electrification (i.e., rapid response to electrification) and are easily controllable with respect to the amount of electrification and charge distribution.

Still another object of the present invention is to provide developers having high stability relative to storage and environmental factors and improved developability and transferring property to enable the formation of high-quality images.

A still further object of the present invention is to provide color developers that have rapid response to electrification and are easily controllable with respect to the amount of electrification and charge distribution.

These objects of the present invention can be attained by using as a charge-exchange control agent an organic boron compound composed of a boron-containing organic anion component and a cation component.

That is, the present invention is directed to a method for controlling charging of toner particles and/or charge-imparting materials used in an electrophotographic machine using as a charge-exchange control agent an organic boron compound composed of a boron-containing organic anion component and a cation component, and to a developer containing the charge-exchange control agent.

DETAILED DESCRIPTION OF THE INVENTION

Boron-containing organic anion components which constitute the organic boron compounds of the present invention are represented by formula (I)

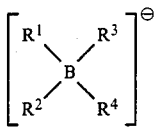

(I)

wherein $R^1$, $R^2$, $R^3$, and $R^4$, which may be the same or different, each represents an organic group, or $R^1$ and $R^2$ together, and $R^3$ and $R^4$ together, form rings.

Preferred examples of boron-containing organic anion components used in the present invention include those represented by formulae (I)-1 to (I)-8

(I)-1

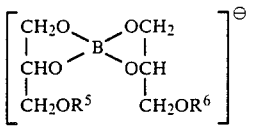

(I)-2

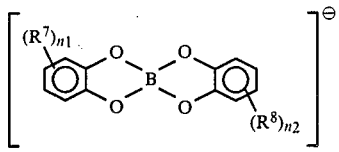

(I)-3

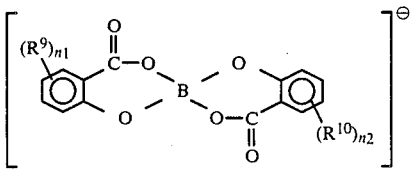

(I)-4

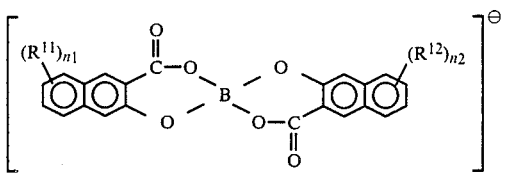

(I)-5

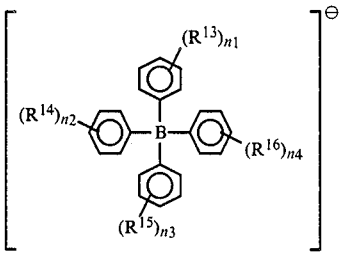

(I)-6

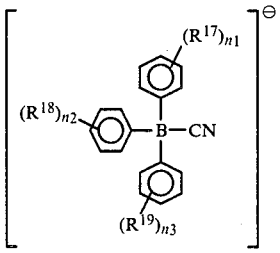

(I)-7

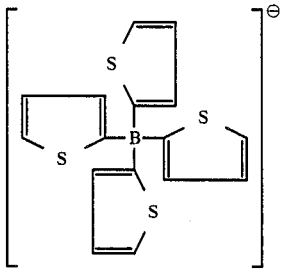

(I)-8

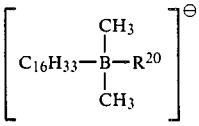

wherein $R^5$ to $R^{19}$ (which may be the same or different) each represents a halogen atom such a chlorine atom and a fluorine atom, an alkyl group such as a methyl group and a butyl group, a haloalkyl group such as a trifluoromethyl group, an aralkyl group such as a benzoyl group, or an aryl group such as a phenyl group and a tolyl group, $R^{20}$ represents a hydrogen atom or an atom or group as defined for $R^5$ to $R^{19}$, and $n_1$ to $n_4$ each represents 0, 1 or 2. The alkyl, haloalkyl, aralkyl, and aryl groups preferably have not more than 20 carbon atoms, and more preferably not more than 12 carbon atoms. When the substituent for $R^5$ to $R^{19}$ is a trifluoromethyl group, the corresponding $n_1$, $n_2$, $n_3$, or $n_4$ is preferably 2.

Examples of cation components which can be used with the boron-containing organic anion component include $H^+$, alkali metal cations such as $Li^+$, $Na^+$, $K^+$, $Rb^+$, $Cs^+$, $Cu^+$, and $Ag^+$, alkaline earth metal cations such as $Be^{2+}$, $Mg^{2+}$, $Ca^{2+}$, $Zn^{2+}$, $Sr^{2+}$, $Cd^{2+}$, and $Ba^{2+}$, other polyvalent metal cations, organic amine type cations such as ammonium, alkyl ammoniums, pyridinium, quinolinium, and imidazolium, sulfonium cations, phosphonium cations, and the like. Of these, $K^+$, $Na^+$, $Cs^+$, and $NH_4^+$ are particularly preferred.

Although it is not completely clear why the organic boron compound having a neutral salt structure composed of a boron-containing organic anion component and a cation component exhibits an excellent charge-exchange controlling property, it is supposed that (i) electron acceptinb boron, (ii) a structure of the neutral salt type and (iii) the organic group bonded to the boron atom, accelerate exchange and transfer of electrons and/or ions in the organic boron compound itself or a composite material having the organic boron compound dispersed or dissolved in a polymer. In particular, the charge-exchange property is enhanced when boron-containing organic anion components having one or more (preferably two or more) aromatic rings (e.g., a benzene ring and a naphthalene ring) in the organic groups for $R^1$ to $R^4$ in formula (I) are used.

The organic boron compounds of the present invention can be synthesized by known methods as described, for example, in U.S. Pat. No. 2,853,525, and *Chemical Abstracts,* Vol. 50, 1646 (1956), Vol. 53, 4211 (1959), and Vol. 64, 15921 (1966). For example, tetraphenylboron sodium can be synthesized in the following manner: reacting triphenylboron or boron trifluoride with phenyllithium to produce tetraphenylboron lithium, dissolving the tetraphenylboron lithium in water to which an aqueous ammonia is further added to precipitate tetraphenylboron ammonium, and refluxing the tetraphenylboron ammonium in the presence of sodium methylate in methanol while generating ammonia, to thereby produce tetraphenylboron sodium, which is separated by removing the solvent.

The basic feature of the charge-exchange control agent and the developer of the present invention resides in the use of boron-containing organic anion components utilizing the electron accepting property of boron, and therefore the charge-exchange control agent of the present invention is effectively used for control of negative electrification and for charge-exchange acceleration of negatively charged materials. In some cases, however, the charge-exchange control agent of the present invention may also be added to positively charged materials so as to improve or control charge-exchange property and electroconductivity of the materials.

Polarity of the organic boron compound upon electrification is considered to vary depending on the kind or molecular size of the boron-containing organic anion component and the cation component thereof. For example, an organic boron compound forming the neutral salt with a certain kind of cation component or a cation component having a large molecular size tends to exhibit positive electrification rather than negative electrification. In this case, the electrification property of the organic boron compound is predominantly determined by the cation components rather than the boron-containing organic anion component.

Since many of the organic boron compounds of the present invention having an excellent charge-controlling property are colorless or light-colored, they can be effectively used not only in black developers, but also in color developers, without causing variation of tone and reduction of transparency. For this purpose, it is particularly preferred that organic boron compounds represented by formula (II) shown below (i.e., using the anion component of formula (I)-5) be used in combination with organic chromatic coloring materials, i.e.,

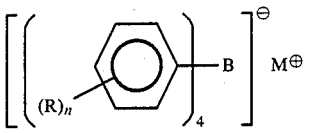

(II)

wherein R has the same meanings as defined above for $R^{13}$, $R^{14}$, $R^{15}$ and $R^{16}$, $M^{\oplus}$ represents a metal cation such as alkali metal cations (e.g., $Li^+$, $Na^+$, $K^+$, $Rb^+$, and $Cs^+$), alkaline earth metal cations (e.g., $Be^{2+}$, $Mg^{2+}$, $Ca^{2+}$, $Sr^{2+}$, and $Ba^{2+}$), transition metal cations (e.g., $Cu^+$, $Zn^{2+}$, and $Ca^{2+}$), and other polyvalent metal cations, and n is 0, 1, or 2. R is preferably a hydrogen atom and $M^{\oplus}$ is preferably $K^+$, $Na^+$, or $Cs^+$.

The organic boron compounds of the present invention are preferably solid at room temperature and have a melting point or softening point of 5° C. or higher. However, when they are used to treat the surface of toner particles, for instance, they may be liquid. Further, such liquid boron compounds may be carried on or impregnated in inorganic fine powder, resinous fine powder, porous substances, or gelatinizers, and used in the form of solid product.

The preferred charge-exchange control agent of formula (II) containing the tetraphenyl anion or derivatives thereof are either colorless or monochromatic and will not affect the color characteristics of the toner particles. In addition, they are solid at ordinary temperatures because of their metal salt structure. Most of them are heat-stable and are not decomposed during toner production such as to experience deterioration of their charge controlling ability and do not melt at low temperatures such as to impair the toner stability relative to storage and environment. These charge-exchange control agents cause no adverse effects on toner fixation by heating, nor do they impair the color forming ability of the developer. Because of these features, the charge-exchange control agents are optimum for use in color developers. These charge-exchange control agents, even if used alone, achieve the intended charge controlling effect, but they may optionally be used in combination with known colorless or pale-colored charge-exchange control agents.

The developer of the present invention contains the above organic boron compounds as charge-exchange control agent generally in an amount of from about 0.01 wt% to about 10 wt%, and preferably from about 0.1 wt% to about 5 wt%, based on the weight of toner particles contained in the developer.

The organic boron compounds of the present invention may be dispersed or dissolved in the interior of the toner particles, selectively adhered on the toner surface, or mixed with the toner particles externally.

The charge-exchange control agent of the present invention may be incorporated in the toner particles by either mechanical or chemical means. In the former case, the charge-exchange control agent is fully mixed with toner components, e.g., binder resins and coloring agents as described below by dry-mixing means such as a vessel-rotating type mixer (e.g., a U-type mixer) and a vessel-fixed type mixer equipped with a stirrer inside of the vessel (e.g., a Henschel mixer), followed by melt kneading, and subjecting it to pulverization and classification. Emulsion mixing and solution mixing may also be applied. In the latter case, a monomer for binder resin is polymerized in the presence of the charge-exchange control agent so as to form chemical bonds between the charge-exchange control agent and the binder resin or other additives in the toner particles. The organic boron compounds may also be mixed with the toner particles as external additive using the above-described vessel-rotating type or vessel-fixing type mixer and the like.

Known binder resins may be used for the toner particles in the present invention and included homo- or copolymers of the following monomers: styrenes such as styrene, chlorostyrene and vinyl styrene; monoolefins such as ethylene, propylene, butylene, and isobutylene; vinyl esters such as vinyl acetate, vinyl propionate, vinyl benzoate and vinyl butyrate; esters of α-methylene aliphatic monocarboxylic acids such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Preferred examples of binder resins include polystyrene, styrene-alkyl acrylate copolymers, styrene-alkyl methacrylate copolymers, styrene-acrylonitrile copolymer, styrene-butadiene copolymer, styrene-maleic anhydride copolymer, polyethylene and polypropylene. Natural or synthetic waxes, modified resin, paraffin, polyesters, polyamides, epoxy resins, polycarbonates, polyurethane, silicone resins, fluorine resins, and petroleum resins may also be used as binder resin. In order to attain good color reproduction by color toners, it is preferred that the above-listed resinous components of binders are either colorless or light-colored, and display a high degree of transparency.

Examples of coloring agents used for the toner particles in the present invention include black dyes and pigments (e.g., carbon black, oil black, and graphite) and organic chromatic coloring materials such as acetoacetic acid acrylamide-based monoazo yellow pigments (Fast Yellow series) (e.g., C.I. Pigment Yellow 1, 3, 74, 97 and 98), acetoacetic acid arylamide-based disazo yellow pigments (e.g., C.I. Pigment Yellow 12, 13 and 14), yellow dyes (e.g., C.I. Solvent Yellow 12, 19, 77 and 79, and C.I. Disperse Yellow 164), red or scarlet pigments (e.g., C.I. Pigment Red 48, 49:1, 53:1, 57, 57:1, 81, 122 and 5), red-based dyes (e.g., C.I. Solvent Red 49, 52, 58 and 8), blue-based dyes or pigments illustrated by copper phthalocyanine and derivatives thereof (e.g., C.I. Pigment Blue 15:3), and green pigments such as C.I. Pigment Green 7 and 36 (phthalocyanine green). Colored or colorless sublimable dyes and other dyes and pigments conventionally used in inks can also be used in the present invention.

These coloring agents may be used either independently or in admixture. Further, the coloring agents may be used in combination with extender pigments, white pigments, etc. to adjust color tone. In order to improve the dispersibility of coloring agent in the binder resin, surface of the coloring agent may optionally be treated with surfactants, coupling agents such as silane coupling agents, or high-molecular weight materials, or high-molecular weight dyes or a high-molecular weight graft pigment may be used.

The content of the coloring agent in the toner particles of the present invention is not limited to any specific value since it depends on various factors such as the specific gravities of toner binder resin, coloring agent and other constituents of the toner, the coloring ability of the coloring agent, and the size distribution of toner particles; it also varies with the amount of toner used in development and the thickness of the layer of toner particles. However, if toner particles used in development are controlled to form approximately one or two layers, an appropriate value of the content of the coloring agent in a toner particles having an average particle size ($d_{50}$) of about 10 $\mu$m would be within the range of from 2 to 10 wt%. The conventration of the coloring agent can be adjusted to a lower value if the average size of the toner particles becomes larger, and vicer versa.

The binder resins and the coloring agents which can be used in the present invention are not limited to those described above.

The toner particles of the present invention may optionally contain magnetic materials such as ferrite generally in an amount of from 30 to 80 wt%, preferably from 50 to 75 wt%, to form magnetic toner. Further, conductivity modifying agents, metal oxides such as tin oxide, silica, alumina, titanium oxide and zinc oxide, extender pigments, reinforcing fillers such as fibrous materials, antioxidants, relase agents, and any other appropriate additives may also be added in the interior of the toner particles or mixed with the toner particles externally.

Various additive may also be attached or fixed to the surfaces of toner particle for improving their flowability and chargeability, or for preventing the filming of toner particles on the surface of a photoreceptor or carrier particles, or for improving the cleanability of residual toner particles from the photoreceptor. Any known additives may be employed for achieving these purposes, and they include higher aliphatic acids such as stearic acid, and derivatives thereof such as metal salts, esters and amides; inorganic fine powders as described in U.S. Pat. No. 3,779,926, such as carbon black, tin oxide, fluorinated graphite, silicon carbide, boron nitride, silica, alumina, titanium dioxide and zinc oxide; powders of resins such as fluorine resins, acrylic resins, and silicone resins; as well as polycyclic aromatic compounds and waxy substances.

The toner particles of the present invention may be produced by any known method including the graining of a mix, spray drying, and direct polymerization. The particle size of the toner particles is preferably adjusted to an average value ($d_{50}$) of from 1 to 20 $\mu$m, and preferably from 5 to 15 $\mu$m, as measured according to the Coulter counter method (according to the PRODUCT REFERENCE MANUAL of Coulter counter Model TA-II type produced by Coulter Electronics Inc.).

The developers of the present invention include a two-component developer comprising toner particles and carrier particles and a single-component developer without carrier particles. In the two-component developer, the toner particles are generally contained in an amount of from 0.1 to 50 wt% based on the total weight of toner particles and carrier particles. Using the developer of the present invention, electrostatic latent images or other information related to electrical signals may be rendered visible by any known methods of electrostatic development.

The salt composed of a boron containing organic anion component and a cation component represented by formula (I) specified hereinabove is used as a charge-exchange control agent and it exhibits superior charge control effects by itself. Further, the charge-exchange control agent of the present invention can be added to the charge imparting materials such as carrier particles or blade or other materials constituting a copying machine which have electrical influences on toner particles upon contact therewith, such as a fixing roller, elements for cleaning the surface of photoreceptor, a toner hopper, etc.

In addition, the salt of a tetraphenylboron anion or a derivative anion thereof and a metal cation represented by formula (II) exhibits even better charge control when used in combination with an organic chromatic coloring material, as compared to when used with an inorganic pigment such as carbon, titanium white, or cadmium yellow. Although the exact reason for this phenomenon is not completely clear, the probable explanation would seem to be as follows: the preferred charge-exchange control agent used in the present invention has (i) electron accepting boron, (ii) a structure of the neutral salt type, and (iii) a phenyl group that stabilizes the boron anion by its resonance effect; these features combine to produce enhanced exchange and transfer of electrons and/or ions on the surface and in the interior of the toner, and this effect is expressed more pronouncedly by synergism with organic chromatic coloring materials which generally are characterized by features such as the presence of polar groups, a resonating structure, a salt structure and a chelate structure.

The combined use of an organic chromatic coloring material with the charge-exchange control agent of the present invention has the additional advantage that the amount of electrification on the toner will experience a much smaller change with variations in the content of the organic chromatic coloring material than when conventional charge-exchange control agents are used. It has also been confirmed that in the presence of the charge-exchange control agent of the present invention, even a fine particulate toner having a high concentration of coloring material can be electrified to provide a desired charge distribution wherein very few toner particles carry charges of a reverse polarity. It is difficult to fully explain this observed phenomenon but, as already explained, the exchange and transfer of electrons and/or ions that occurs in the toner particles of the present invention is so rapid that the surface of the toner particles would be uniformly charged at a sufficiently fast rate to reduce any adverse effect of the high concentration of coloring material present in the interior of toner particles.

The present invention is explained in more detail by reference to the following examples, but the present invention is not limited thereto. Unless otherwise indicated, all parts in the following examples are by weight.

EXAMPLE 1

| | |
|---|---|
| Styrene/n-butyl methacrylate copolymer (Tg, 60° C.; Mn (number average molecular weight), 7,000; Mw (weight average molecular weight), 42,000) | 100 parts |
| Magenta pigment (Brilliant Carmine 6B: C.I. Pigment Red 57) | 4 parts |
| Tetraphenylboron sodium | 1 part |

The above-mentioned components were melted and mixed together. The mixture was cooled to form a solid mass, which was ground and classified to obtain magenta toner particles having an average particle size ($d_{50}$) of 12 μm.

COMPARATIVE EXAMPLE 1A

| | |
|---|---|
| Styrene/n-butyl methacrylate copolymer (same as in Example 1) | 100 parts |
| Magenta pigment (same as in Example 1) | 4 parts |

The above-mentioned components were processed as in Example 1 to prepare magenta toner particles having an average particle size ($d_{50}$) of 12 μm.

COMPARATIVE EXAMPLE 1B

| | |
|---|---|
| Styrene/n-butyl methacrylate copolymer (same as in Example 1) | 100 parts |
| Magenta pigment (same as in Example 1) | 4 parts |
| White charge-exchange control agent (E-84 of Orient Chemical Industry Co., Ltd.) | 2 parts |

The above-mentioned components were processed as in Example 1 to prepare magenta toner particles having an average particle size ($d_{50}$) of 12 μm.

EXAMPLE 2

| | |
|---|---|
| Styrene/n-butyl methacrylate copolymer (same as in Example 1) | 100 parts |
| Magenta pigment (same as in Example 1) | 7 parts |
| Tetraphenylboron sodium | 1 part |

The above-mentioned components were processed as in Example 1 to prepare magenta toner particles having an average particle size ($d_{50}$) of 7 μm.

COMPARATIVE EXAMPLE 2A

| | |
|---|---|
| Styrene/n-butyl methacrylate copolymer (same as in Example 1) | 100 parts |
| Magenta pigment (same as in Example 1) | 7 parts |

The above-mentioned components were processed as in Example 1 to prepare magenta toner particles having an average particle size ($d_{50}$) of 7 μm.

COMPARATIVE EXAMPLE 2B

| | |
|---|---|
| Styrene/n-butyl methacrylate copolymer (same as in Example 1) | 100 parts |
| Magenta pigment (same as in Example 1) | 7 parts |
| White charge-exchange control agent (same as in Comparative Example 1B) | 2 parts |

The above-mentioned components were processed as in Example 1 to prepare magenta toner particles having an average particle size ($d_{50}$) of 7 μm.

Each of the toner particles prepared in Examples 1 and 2 and Comparative Examples 1A, 1B, 2A and 2B were mixed with a carrier (iron powder with $d_{50}$ of about 100 μm). The charging characteristics of the thus prepared developers were evaluated at three different conditions, i.e., at ordinary temperature and humidity (22° C.; 55% RH), in a hot and humid atmosphere (35° C.; 80% RH), and in a cold and dry atmosphere (10° C.; 20% RH). The evaluation included the measurement of average amount of charges by blowoff triboelectrification and the measurement of charge distribution by charge spectrography. The results are shown in Table 1. The weight ratio of carrier to toner particles was 100/3 in Example 1 and Comparative Examples 1A and 1B in which toner particles having an average size of 12 μm were prepared, and 100/1.75 in Example 2 and Comparative Examples 2A and 2B in which toner particles having an average size of 7 μm were prepared.

TABLE 1

| | Example 1 | Comparative Example 1A | Comparative Example 1B | Example 2 | Comparative Example 2A | Comparative Example 2B |
|---|---|---|---|---|---|---|
| Ordinary Temperature and Humidity | | | | | | |
| Amount of blowoff electrification (μC/g) (1) | −15 | −20 | −16 | −38 | −42 | −40 |
| Response to electrification (2) | A | B | A | A | C | B |
| Amount of toner particles of reverse polarity (3) | A | A | A | A | C | C |
| Hot and Humid Atmosphere | | | | | | |
| Amount of blowoff electrification (μC/g) (1) | −12 | −7 | −11 | −30 | −10 | −25 |
| Response to electrification (2) | A | B | A | A | B | B |
| Amount of toner particles of reverse polarity (3) | A | B | A | A | C | C |
| Cold and Dry Atmosphere | | | | | | |

TABLE 1-continued

| | Example 1 | Comparative Example 1A | Comparative Example 1B | Example 2 | Comparative Example 2A | Comparative Example 2B |
|---|---|---|---|---|---|---|
| Amount of blowoff electrification (μC/g) (1) | −14 | −18 | −18 | −35 | −35 | −40 |
| Response to electrification (2) | A | C | A | A | C | B |
| Amount of toner particles of reverse polarity (3) | A | C | B | A | C | C |

Note:
(1) Measured after 1-minute mixing in a high-speed agitator type mixer.
(2) Relative values of the amount of blowoff electrification as measured after 5-second mixing in a high-speed agitator type mixer, with the values measured after 1-minute mixing being taken as 100; the following criteria were used: A, >75%; B, 75–50%; C, <50%.
(3) Measured by charge spectrography [for details of this method, see "Electrophotography", The Society of Electrophotography of Japan, 22, 85 (1983)] after mixing for 1 minute; the following criteria were used: A, <2%; B, 2–10%; C, >10%.

The amount of blowoff electrification on developers varies with the type of mixer used and, with a low-speed agitator type mixer, it usually takes at least 10 minutes and sometimes as long as several hours for the amount of electrification to reach a substantially saturated level. The values (the amounts of blowoff electrification) shown in Table 1 may well be considered to represent a substantially saturated state of electrification.

As is clear from Table 1, the toner particles prepared in accordance with the present invention (Examples 1 and 2) exhibited much better charging characteristics over those prepared in Comparative Examples 1A and 2B which did not contain any charge-exchange control agent and this is manifested by significant improvements in the stability of the amount of charges in various conditions of environment, quick response to electrification, and in turn sharp charge distribution.

The toner particles of the present invention did not show any deterioration of its charging properties even when its pigment content was increased and its average particle size decreased. The sample prepared in Comparative Example 1B by using a commercial product of charge-exchange control agent and which had an average toner particle size of 12 μm was not much inferior to the toner particles of the present invention in terms of charging characteristics. However, when its pigment loading was increased and the average particle size reduced to 7 μm as in Comparative Example 2B, the rise time of electrification was prolonged and the amount of toner particles of reverse polarity was significantly increased. In addition, the stability to the environment of the sample prepared in Comparative Example 2B was also poor.

In another experiment, magenta toner particles of the same type as prepared in Example 1 were mixed with 0.7 wt% of a fine hydrophobic silica powder and 0.8 wt% of a metal salt of aliphatic acid, and the mixture was combined with a carrier ferrite powder ($d_{50}$, about 70 μm) to formulate a color developer. Using this developer, 5,000 copies were continuously produced on a copier, FX-2300 of Fuji Xerox Co., Ltd. All of the copies made had consistently sharp magenta color images without fogging.

In a similar manner, magenta toner particles of the same type as prepare in Example 2 were mixed with 1.2 wt% of a fine hydrophobic silica powder and 1.4 wt% of a metal salt of aliphatic acid, and the mixture was likewise treated to formulate a color developer. Using this developer, 5,000 copies were continuously produced on a copier which was a modified version of FX-2300 that was equipped with a single-component development system. As in the case of the magenta toner particles of Example 1, all of the copies made had very sharp magenta color images without fogging. The single-component development system was composed of (1) developing roller (diameter: 20 mm) with a surface layer comprising a crosslinked phenol resin, a reinforcing agent, and carbon black and having an electric resistance of about $10^{11}$ Ωcm, (2) a toner supplying roller of an electroconductive rubber to mechanically supply toner particles on the developing roller, and (3) a blade with a surface layer comprising a silicone rubber, a reinforcing agent and a charge control agent, which was pressed on the developing roller to charge the toner particles by triboelectrification and to adjust the thickness of the toner layer formed on the developing roller.

EXAMPLE 3

Cyan and yellow toner particles each having an average particle size ($d_{50}$) of 12 μm were prepared as in Example 1, except that 4 parts of the magenta pigment was replaced by 4 parts of a cyan pigment (B type copper phthalocyanine; C.I. Pigment Blue 15:3) or 4 parts of a yellow pigment (disazo yellow; C.I. Pigment Yellow 12), respectively.

The charging characteristics of the two toner particles were evaluated by the same methods as used in Example 1. The amount of blowoff electrification on the cyan toner particles was <13 μC/g in the hot and humid atmosphere, and −17 μC/g in the cold and dry atmosphere, and the corresponding values for the yellow toner particles were −12 μC/g and −15 μC/g, respectively. It was therefore clear that the cyan and yellow toner particles prepared in accordance with the present invention were stable to the environment. They also had no problem with respect to the response to electrification and the amount of toner particles of reverse polarity.

EXAMPLE 4

Magenta toner particles of the same type as prepared in Example 1 were mixed with 1.0 wt% of a fine hydrophobic silica powder to prepare a single-component developer. Using the resulting developer, 5,000 copies were continuously produced on the modified version of FX-2300 as used in Example 2. All of the copies made had very good images.

EXAMPLE 5

Yellow toner particles having an average particle size of 12 μm were prepared as in Example 1 except that 4 parts of the magenta pigment was replaced by 6 parts of a yellow pigment (C.I. Pigment Yellow 97). The charging characteristics of these toner particles were evaluated by the same methods as used in Example 1. The amount of blow-off electrification was −17 μC/g at ordinary temperature and humidity, −15 μC/g in the hot and humid atmosphere, and −19 μC/g in the cold and dry atmosphere. The toner particles also had no problem with respect to the response to electrification and the amount of toner particles of reverse polarity.

Using these toner particles, 5,000 copies were continuously produced on a copier, FX-2300 as in Example 1. All of the copies made had consistently sharp yellow images without fogging.

EXAMPLE 6

| | |
|---|---|
| Styrene/n-butyl methacrylate copolymer (same as in Example 1) | 100 parts |
| Cyan dye (copper tetra(octadecylsulfonamido)phthalocyanines) | 6 parts |
| Tetraphenylboron sodium | 1.5 parts |

The above-mentioned components were processed as in Example 1 to prepare cyan toner particles having an average particle size ($d_{50}$) of 12 μm.

The charging characteristics of these toner particles were evaluated by the same methods as used in Example 1. The amount of blowoff electrification was −18 μC/g at ordinary temperature and humidity, −14 μC/g in the hot and humid atmosphere, and −18 μC/g in the cold and dry atmosphere. It was therefore clear that these toner particles were stable to the environment. It also had no problem with respect to the response to electrification and the amount of toner particles of reverse polarity.

Using these toner particles, 5,000 copies were continuously produced on FX-2300 as in Example 1. All of the copies made had consistently sharp cyan images without fogging.

EXAMPLE 7

| | |
|---|---|
| Styrene/butyl acrylate/maleic anhydride copolymer (Tg, 65° C.; Mn, 8,000; Mw, 35,000) | 100 parts |
| Magenta pigment (C.I. Pigment Red 122) | 6 parts |
| Tetraphenylboron sodium | 1 part |

The above-mentioned components were processed as in Example 1 to prepare magenta toner particles having an average particle size ($d_{50}$) of 12 μm. A developer was prepared by mixing these toner particles with a carrier that was formed of iron particles having a methyl methacrylate resin coat.

The charging characteristics of these toner particles were evaluated by the same methods as used in Example 1. As a result, the amount of electrification was −14 μC/g in the hot and humid atmosphere, and −17 μC/g in the cold and dry atmosphere. It was therefore clear that these tonet particles were stable to the environment. The toner particles also had no problem with respect to the response to electrification and the amount of toner particles with reverse polarity.

EXAMPLE 8

Three magenta toner particles (Sample Nos. 8-A, 8-B, and 8-C) each having an average particle size ($d_{50}$) of 12 μm were prepared as in Example 1, except that 1 part of the tetraphenylboron sodium was replaced by the following compound, respectively.

| | |
|---|---|
| (A) tetraphenylboron potassium | 1 part |
| (B) tetra(p-fluorophenyl)boron sodium | 1 part |
| (C) tetra(p-chlorophenyl)boron potassium | 1 part |

The charging characteristics of these toner particles were evaluated by the same methods as used in Example 1. As shown in Table 2, the amounts of electrification on the toner particles were stable in all of the testing conditions. The three toner particles also had no problem in respect to the response to electrification and the amount of toner particles of reverse polarity.

TABLE 2

| Sample No. | Ordinary Temperature and Humidity (μC/g) | Hot and Humid Atmosphere (μC/g) | Cold and Dry Atmosphere (μC/g) |
|---|---|---|---|
| 8-A | −21 | −18 | −22 |
| 8-B | −20 | −17 | −18 |
| 8-C | −22 | −18 | −20 |

EXAMPLE 9

| | |
|---|---|
| Crosslinked polyester (Tg, 64° C.; Mn of solvent (chloroform)-soluble portion, 1,500; Mw of solvent-soluble portion, 35,000; acid value, 18) | 100 parts |
| Cyan pigment (B type copper phthalocyanine; C.I. Pigment Blue 15:3) | 3 parts |
| Tetraphenylboron potassium | 1 part |

The above-mentioned components were processed as in Example 1 to prepare cyan toner particles.

The charging characteristics of these toner particles were evaluated by the same methods as used in Example 1, and as a result, the amount of blowoff electrification was −23 μC/g at ordinary temperature and humidity, −20 μC/g in the hot and humid atmosphere, and −25 μC/g in the cold and dry atmosphere. It was therefore clear that the toner particles were stable to the environment. The toner particles also had no problem with respect to the response to electrification and the amount of toner particles with reverse polarity.

Using this toner particles, 5,000 copies were produced on FX-2300 as in Example 1. All of the copies made had consistently sharp cyan images without fogging.

EXAMPLE 10

| | |
|---|---|
| Styrene/butyl acrylate copolymer (Tg, 60° C.; Mn, 7,500; Mw, 50,000) | 100 parts |
| Rhodamine-based magenta dye (C.I. Solvent Red 49) | 7 parts |
| Tetraphenylboron potassium | 1 part |

The above-mentioned components were processed as in Example 1 to prepare magenta toner particles having an average particle size ($d_{50}$) of 12 μm. A developer was formed by mixing these toner particles with an uncoated carrier ferrite.

The charging characteristics of these toner particles were evaluated by the same methods as used in Example 1, and as a result, the amount of electrification was −12 μC/g in the hot and humid atmosphere, and −15 μC/g in the cold and dry atmosphere. It was therefore clear that the toner particles were stable to the environment. The toner particles also had no problem with respect to the response to electrification and the amount of toner particles with reverse polarity.

EXAMPLE 11

| | |
|---|---|
| Styrene/butyl acrylate copolymer (Tg, 65° C.; Mn, 5,000; Mw, 18,000) | 25 parts |
| Styrene/butyl acrylate copolymer (Tg, 65° C.; Mn, 20,000; Mw, 61,000) | 25 parts |
| Styrene/butyl acrylate copolymer (Tg, 65° C.; solvent (chloroform)-insoluble gel content, 90%) | 50 parts |
| Low-molecular weight polypropylene wax (Mw, 6,500) | 5 parts |
| Cyan pigment (C.I. Solvent Blue 15:3) | 3 parts |
| Yellow pigment (C.I. Solvent Yellow 12) | 3 parts |
| White pigment (titanium oxide) | 4 parts |
| Tetraphenylboron potassium | 1 part |

The above-mentioned components were processed as in Example 1 to prepare green toner particles having an average particle size ($d_{50}$) of 12 μm. These toner particles were mixed with 0.7 wt% of a fine hydrophobic silica powder and 0.6 wt% of a methyl methacrylate resin powder. The color developer was formulated by combining the resulting mixture with a carrier that was composed of iron particles having a modified silicone resin coat.

The charging characteristics of the toner particles were evaluated by the same methods as used in Example 1, and as a result, the amount of blowoff electrification was −22 μC/g at ordinary temperature and humidity, −18 μC/g in the hot and humid atmosphere, and −23 μC/g in the cold and dry atmosphere. It was therefore clear that the toner particles were stable to the environment. The toner particles also had no problem with respect to the response to electrification and the amount of toner particles of reverse polarity.

Using this developer, 10,000 copies were continuously produced on a copier, FX-2830 of Fuji Xerox Co., Ltd. All of the copies made had consistently sharp green images without fogging.

EXAMPLE 12

Magenta toner particles having an average particle size ($d_{50}$) of 12 μm were prepared as in Example 1 except that 1 part of the tetraphenylboron sodium was replaced by 1 part of tetra-p-tolylboron sodium having the following formula.

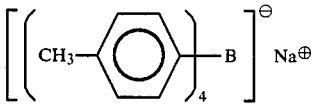

A developer was prepared by combining these toner particles with a carrier made of uncoated ferrite particles.

The charging characteristics of the toner particles were evaluated by the same methods as used in Example 1, and as a result, the amount of blowoff electrification was −18 C/g at ordinary temperature and humidity, −15 μC/g in the hot and humid atmosphere, and −17 μC/g in the cold and dry atmosphere. It was therefore clear that the toner particles were stable to the environment. The toner particles also had no problem with respect to the response to electrification and the amount of toner particles of reverse polarity.

EXAMPLE 13

Magenta toner particles having an average particle size ($d_{50}$) of 12 μm were prepared as in Example 1 except that 1 part of the tetraphenylboron sodium was replaced by 1.5 parts of tetraphenylboron calcium having the following formula.

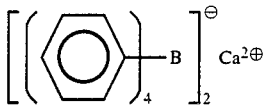

A developer was prepared by combining these toner particles with a carrier that was made of ferrite particles having a modified silicone coat.

The charging characteristics of the toner particles were evaluated by the same methods as used in Example 1, and as a result, the amount of blowoff electrification was −20 μC/g at ordinary temperature and humidity, −18 μC/g in the hot and humid atmosphere, and −19 μC/g in the cold and dry atmosphere. It was therefore clear that the toner particles were stable to the environment. The toner particles also had no problem with respect to the response to electrification and the amount of toner particles of reverse polarity.

EXAMPLE 14

| | |
|---|---|
| Polyester resin (Tg, 64° C.; solvent-insoluble gel content, 15%) | 100 parts |
| Carbon black | 10 parts |
| Tetramethylammonium salt of dicatecholborate | 1 part |

The above-mentioned components were processed as in Example 1 to prepare toner particles having an average particle size ($d_{50}$) of 9 μm. A developer was formed by mixing these toner particles with an uncoated carrier ferrite ($d_{50}$, about 80 μm) in a mixing ratio of the toner particles to the carrier ferrite of 3/100 by weight.

The charging characteristics of this toner particles were evaluated by the same methods as used in Example 1, and as a result, the amounts of electrification were stable in all of the testing conditions and were within the range of from −17 μC/g to −21 μC/g. The toner particles also had no problem with respect to the response to electrification and the amount of toner particles of reverse polarity.

These toner particles were mixed with 0.7 wt% of a fine hydrophobic silica powder and 0.7 wt% of methyl methacrylate fine powder. Using the resulting mixture, 10,000 copies were produced on the modified version of FX-2300 as in Example 2. All of the copies made had consistently sharp images without fogging.

EXAMPLE 15

| | |
|---|---|
| Styrene/butyl acrylate copolymer (Tg, 60° C.; Mn, 4,000; Mw, 15,000) | 50 parts |
| Styrene/butyl acrylate copolymer (Tg, 60° C.; Mn, 160,000; Mw, 430,000) | 50 parts |
| Low molecular weight polypropylene (Mw, 6,500) | 5 parts |
| $\gamma$-$Fe_2O_3$ fine powder | 100 parts |
| Tetramethylammonium salt of dicatecholborate | 2 parts |

The above-mentioned components were processed as in Example 1 to prepare sepia toner particles having an average particle size ($d_{50}$) of 12 μm. A single-component developer was formed by mixing these toner particles with 0.4 wt% of a hydrophobic alumina fine powder and 0.1 wt% of tin oxide fine powder.

Using this developer, 5,000 copies were produced on the modified version of FX-2300 as in Example 4. All of the copies made had consistently sharp sepia images without fogging.

While the invention has been described in detail and with reference to specific embodiments thereof, it will be apparent to one skilled in the art that various changes and modifications can be made therein without departing from the spirit and scope thereof.

What is claimed is:

1. A method for controlling charging of toner particles by adding in the toner particles or in a charge-imparting material which is brought into contact with the toner particles and which has electrical influences on the toner particles upon contact therewith, or mixing with the toner particles externally an organic boron compound, as a charge-exchange control agent, composed of a boron-containing organic anion component selected from those represented by formulae (I)-1 to (I)-8

(I)-1

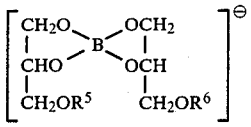

(I)-2

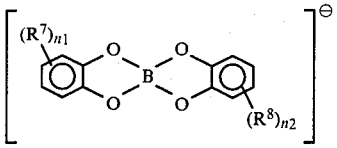

(I)-3

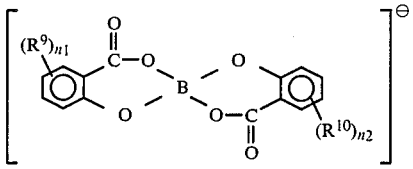

(I)-4

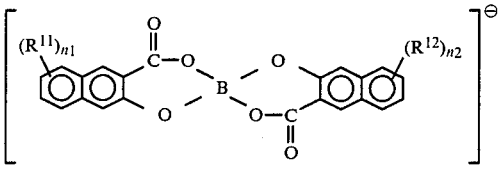

(I)-5

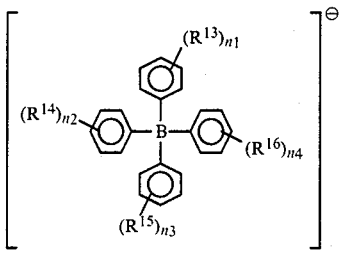

-continued (I)-6

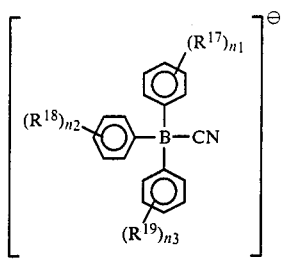

(I)-7

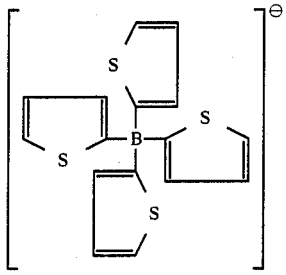

(I)-8

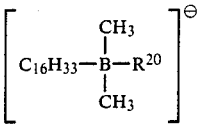

wherein $R^5$ to $R^{19}$ each represents a halogen atom, an alkyl group, a haloalkyl group, an aralkyl group, or an aryl group, $R^{20}$ represents a hydrogen atom or an atom or group as defined for $R^5$ to $R^{19}$, and $n_1$ to $n_4$ each represents 0, 1, or 2, and a cation component selected from the group consisting of $H^+$, alkali metal cations, alkaline earth metal cations, ammonium, quinolinium, imidazolium, sulfonium cations.

2. A method as in claim 1, wherein said organic boron compound is represented by formula (II)

(II)

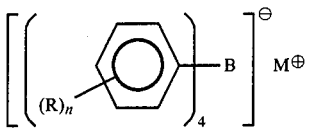

wherein R represents an atom or group as defined in claim 1 for $R^{13}$ $R^{14}$, $R^{15}$ and $R^{16}$, $M^{\oplus}$ represents a metal cation, and n is 0, 1, or 2.

3. A developer as in claim 1, wherein said organic boron compound is contained in the toner particles.

4. A toner composition for developing an electrostatic latent image, comprising toner particles and as a charge-exchange control agent an organic boron compound composed of a boron-containing organic anion component selected from those represented by formulae (I)-1 to (I)-8

(I)-1

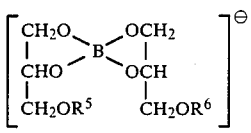

-continued (I)-2

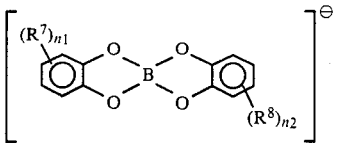

(I)-3

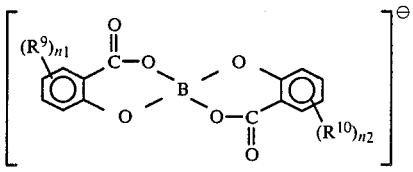

(I)-4

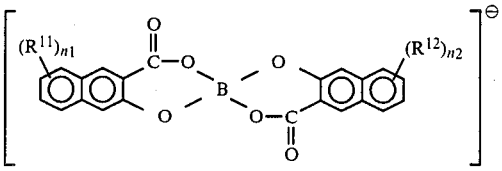

(I)-5

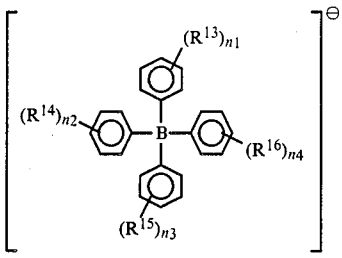

(I)-6

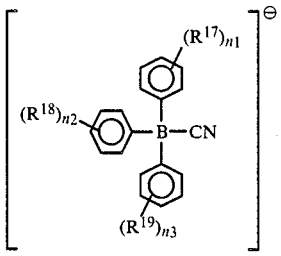

(I)-7

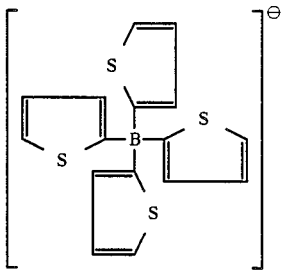

(I)-8

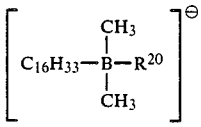

wherein $R^5$ to $R^{19}$ each represents a halogen atom, an alkyl group, a haloalkyl group, an aralkyl group, or an aryl group, $R^{20}$ represents a hydrogen atom or an atom or group as defined for $R^5$ to $R^{19}$, and $n_1$ to $n_4$ each represents 0, 1, or 2, and a cation component selected from the group consisting of $H^+$, alkali metal cations, alkaline earth metal cations, ammonium, quinolinium, imidazolium, and sulfonium cations.

5. A developer as in claim 4, wherein said organic boron compound is represented by formula (II)

(II)

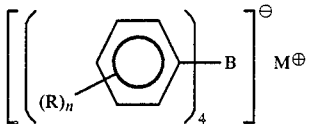

wherein R represents an atom or group as defined in claim 4 for $R^{13}$ $R^{14}$, $R^{15}$ and $R^{16}$, $M^{\oplus}$ represents a metal cation, and n is 0, 1 or 2.

6. A toner composition as in claim 4, wherein the amount of said organic boron compound is from 0.01 to 10 wt% based on the weight of the toner particles.

7. A toner composition as in claim 6, wherein the amount of the organic boron compound is from 0.1 to 5 wt%.

8. A toner composition as in claim 4, wherein said organic boron compound is contained in the toner particles.

9. A toner composition as in claim 5, wherein said toner particles contain an organic chromic coloring material as a coloring agent.

10. A developer composition for developing an electrostatic latent image, comprising carrier particles, toner particles, and as a charge-exchange control agent an organic boron compound composed of a boron-containing organic anion component selected from those represented by formulae (I)-1 to (I)-1

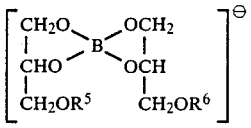

(I)-2

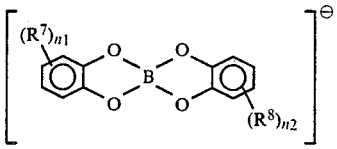

(I)-3

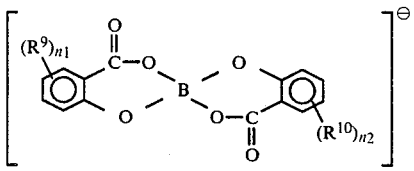

(I)-4

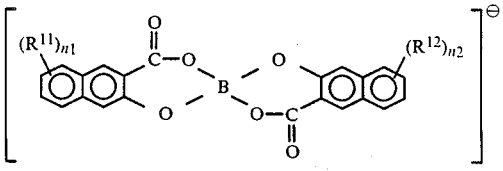

-continued (I)-5

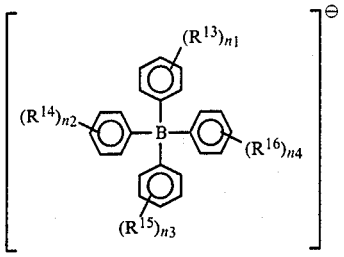

(I)-6

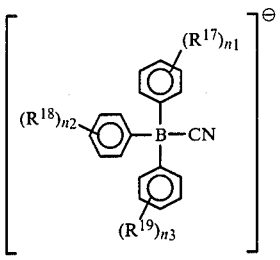

(I)-7

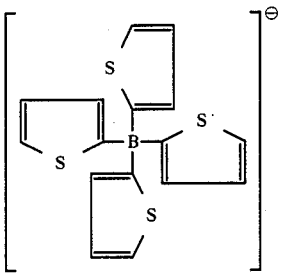

-continued (I)-8

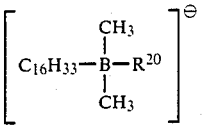

wherein $R^5$ to $R^{19}$ each represents a halogen atom, an alkyl group, a haloalkyl group, an aralkyl group, or an aryl group, $R^{20}$ represents a hydrogen atom or an atom or group as defined for $R^5$ to $R^{19}$, and $n_1$ to $n_4$ each represents 0, 1, or 2, and a cation component selected from the group consisting of $H^+$, alkali metal cations, alkaline earth metal cations, ammonium, quinolinium, imidazolium, and sulfonium cations.

11. A developer as in claim 10, wherein said organic boron compound is represented by formula (II)

(II)

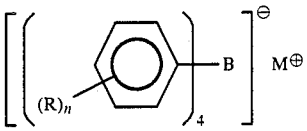

wherein R represents an atom or group as defined in claim 10 for $R^{13}$, $R^{14}$, $R^{15}$ and $R^{16}$, $M^+$ represents a metal cation, and n is 0, 1 or 2.

12. A developer as in claim 10, wherein the amount of said organic boron compound is from 0.01 to 10 wt% based on the weight of the toner particles.

13. A developer as in claim 12, wherein the amount of the organic boron compound is from 0.1 to 5 wt%.

14. A developer as in claim 10, wherein said organic boron compound is contained in the toner particles.

15. A developer as in claim 11, wherein said toner particles contain an organic chromic coloring material as a coloring agent.

16. A toner composition for developing an electrostatic latent image as in claim 4 wherein said toner particles are negatively charged.

17. A developer composition for developing an electrostatic latent image as in claim 10 wherein said toner particles are negatively charged.

18. A developer as in claim 3, wherein the charge-exchange control agent is positively charged.

* * * * *